US012648632B2

(12) United States Patent
Bickford

(10) Patent No.: US 12,648,632 B2
(45) Date of Patent: Jun. 9, 2026

(54) COSMETIC APPLICATOR WITH DYNAMICALLY FLEXIBLE STEM SUPPORT

(71) Applicant: L'Oreal, Paris (FR)

(72) Inventor: William Bickford, Scotch Plains, NJ (US)

(73) Assignee: L'Oreal, Paris (FR)

( * ) Notice: Subject to any disclaimer, the term of this patent is extended or adjusted under 35 U.S.C. 154(b) by 293 days.

(21) Appl. No.: 18/477,833

(22) Filed: Sep. 29, 2023

(65) Prior Publication Data

US 2025/0107611 A1 Apr. 3, 2025

(51) Int. Cl.
*A45D 40/26* (2006.01)

(52) U.S. Cl.
CPC ..... *A45D 40/26* (2013.01)

(58) Field of Classification Search
CPC ..... A45D 40/26; A45D 40/268; A45D 34/04; A45D 220/10; A45D 2200/10
See application file for complete search history.

(56) References Cited

U.S. PATENT DOCUMENTS

| | | | | |
|---|---|---|---|---|
| 7,467,905 | B2 * | 12/2008 | Habatjou | A46B 9/021 401/126 |
| 2018/0255908 | A1 | 9/2018 | Wightman | |
| 2019/0261764 | A1 | 8/2019 | Burger | |
| 2020/0237086 | A1 | 7/2020 | Crapet et al. | |
| 2020/0323327 | A1 | 10/2020 | Bose et al. | |
| 2022/0061502 | A1 | 3/2022 | Bickford | |
| 2022/0369791 | A1 | 11/2022 | Crapet | |

FOREIGN PATENT DOCUMENTS

| | | | | |
|---|---|---|---|---|
| CN | 206852277 | U | 1/2018 | |
| DE | 102014117994 | A1 * | 6/2016 | A45D 40/262 |
| EP | 2878223 | B1 | 2/2017 | |
| EP | 3028598 | B1 | 2/2019 | |
| EP | 3028599 | B1 | 3/2019 | |
| JP | 2013081661 | A | 5/2013 | |
| JP | 2014200507 | A | 10/2014 | |
| JP | 2015126822 | A | 7/2015 | |
| JP | 6287207 | B2 | 3/2018 | |
| KR | 101770581 | B1 | 8/2017 | |
| KR | 102096492 | B1 | 4/2020 | |
| WO | 2021123335 | A1 | 6/2021 | |

OTHER PUBLICATIONS

International Search Report and Written Opinion for FR2313139 filed on Nov. 28, 2023, dated May 15, 2024. 6 pages.

* cited by examiner

*Primary Examiner* — Rachel R Steitz
(74) *Attorney, Agent, or Firm* — Christensen O'Connor Johnson Kindness PLLC

(57) ABSTRACT

Cosmetic applicators that are adjustable for ergonomic use, cosmetic composition products such as kits, and methods of use. A cosmetic applicator includes a first stem limb, a second stem limb, and at least one applicator limb that can hold and deposit a cosmetic composition onto a portion of a body of an individual. The least one applicator limb is flexibly connected to the first stem limb and the second stem limb, which securely interact. The first stem limb is adjustable relative to the second stem limb to define values of angles between the first stem limb and the at least one applicator limb and between the at least one applicator limb and the second stem limb. Adjustment of these angles in turn adjusts an angle between the at least one applicator limb and the handle for customized and improved ergonomic use of the cosmetic applicator.

12 Claims, 6 Drawing Sheets

COSMETIC APPLICATOR WITH DYNAMICALLY FLEXIBLE STEM SUPPORT

SUMMARY

In an aspect, the disclosure provides a cosmetic applicator, comprising: a plurality of limbs attached by a plurality of hinges, wherein the plurality of limbs comprises a first stem limb and a second stem limb configured to securely interact to form a stem configuration and at least one applicator limb configured to hold and deposit a cosmetic composition; wherein a position of the first stem limb relative to the second stem limb in the stem configuration defines one or more angles between two or more limbs of the plurality of limbs.

In embodiments, hinges of the plurality of hinges are living hinges.

In embodiments, the at least one applicator limb is flexibly connected to the first stem limb and the second stem limb by a first hinge of the plurality of hinges and a second hinge of the plurality of hinges, respectively.

In embodiments, the at least one applicator limb comprises an elongated groove thereon configured to hold and deposit the cosmetic composition.

In embodiments, the elongated groove extends through the at least one applicator limb to form an elongated aperture.

In embodiments, the stem configuration comprises a joint formed between a portion of the first stem limb and a portion of the second stem limb to secure the stem configuration against horizontal movement of the first stem limb relative to the second stem limb.

In embodiments, the portion of the first stem limb is a male portion and the portion of the second stem limb is a female portion.

In embodiments, a vertical movement of the first stem limb relative to the second stem limb at the stem configuration adjusts the position of the first stem limb relative to the second stem limb and adjusts the one or more angles between the two or more limbs of the plurality of limbs.

In embodiments, the cosmetic applicator further comprises a threaded sleeve that comprises threading on an inner portion thereof that is engaged with threading on an outer portion of the first stem limb, wherein rotation of the threaded sleeve relative to the stem configuration enables the vertical movement of the first stem limb relative to the second stem limb at the stem configuration.

In embodiments, the one or more angles comprises an alpha angle between the first stem limb and the at least one applicator limb and a beta angle between the at least one applicator limb and the second stem limb.

In an aspect, the disclosure provides a cosmetic applicator, comprising: a first stem limb, a second stem limb, and at least one applicator limb configured to hold and deposit a cosmetic composition, wherein the at least one applicator limb is flexibly connected to the first stem limb and is flexibly connected to the second stem limb, wherein the first stem limb and the second stem limb are configured to securely interact to form a stem configuration; wherein a position of the first stem limb relative to the second stem limb in the stem configuration is adjustable with a vertical movement of the first stem limb relative to the second stem limb to define an alpha angle between the first stem limb and the at least one applicator limb and a beta angle between the at least one applicator limb and the second stem limb.

In embodiments, the cosmetic applicator further comprises a threaded sleeve that comprises threading on an inner portion thereof that is engaged with threading on an outer portion of the first stem limb, wherein rotation of the threaded sleeve relative to the stem configuration enables the vertical movement of the first stem limb relative to the second stem limb at the stem configuration for adjustment of the position of the first stem limb relative to the second stem limb in the stem configuration.

In embodiments, the at least one applicator limb is flexibly connected to the first stem limb by a first living hinge and is flexibly connected to the second stem limb by a second living hinge.

In embodiments, the at least one applicator limb comprises an elongated groove thereon configured to hold and deposit the cosmetic composition.

In embodiments, the elongated groove extends through the at least one applicator limb to form an elongated aperture.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Figure 1A:
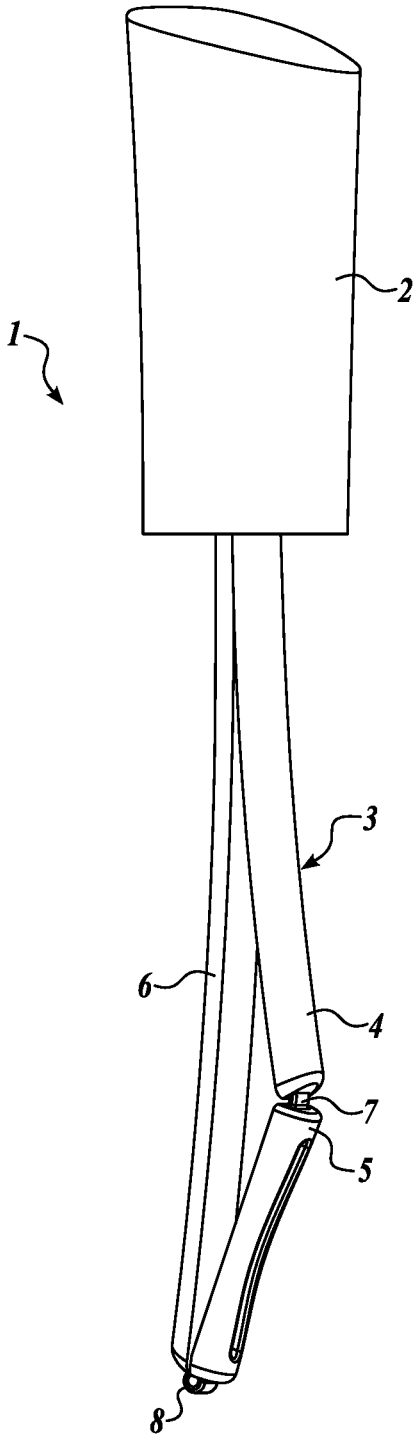
FIG. 1A shows a perspective view of an example cosmetic applicator, according to aspects of the disclosure.
Figure 1B:
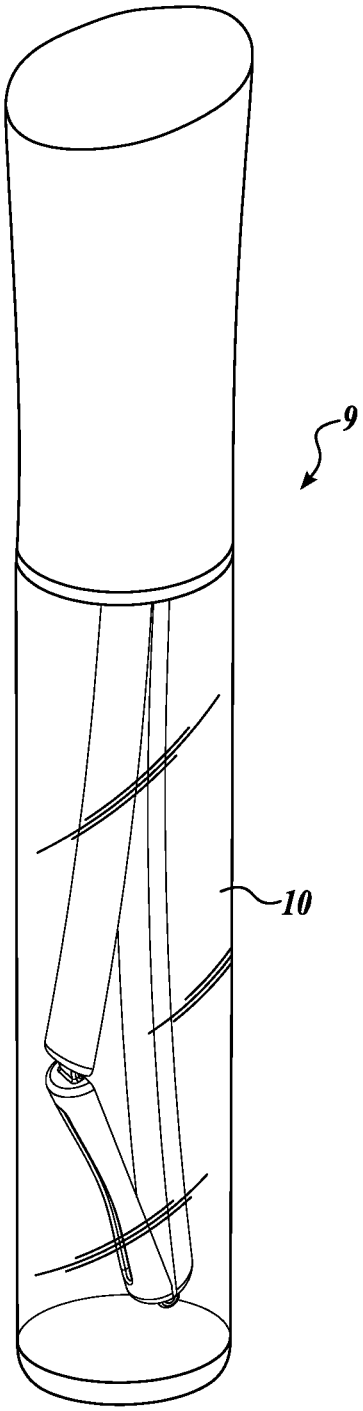
FIG. 1B shows a perspective view of an example cosmetic applicator secured to a container for an applicator assembly, according to aspects of the disclosure.

The foregoing aspects and many of the attendant advantages of this invention will become more readily appreciated as the same become better understood by reference to the following detailed description, when taken in conjunction with the accompanying drawings.

DETAILED DESCRIPTION

Many existing cosmetic applicators have rigid or non-adjustable designs that can cause discomfort or strain during use for application of cosmetics. These cosmetic applicators can be particularly problematic for individuals with limited or painful movement of the hands. In these and other instances, there is a need for a cosmetic applicator that has a flexible and adjustable design for avoidance of discomfort or strain during use for application of cosmetics. The present disclosure addresses these and other long-felt and unmet needs in the art.

FIGS. 1A, 2A-2D, and 3A-3C show example cosmetic applicators configured for adjustment and customization to an individual's ergonomic needs. A cosmetic applicator 3 comprises a plurality of limbs (4, 5, 6) attached by a plurality of hinges (7, 8). In the shown embodiments, the plurality of limbs comprises a first stem limb 4 and a second stem limb 6 configured to securely interact to form a stem configuration 14. In addition, at least one applicator limb 5 is included and is configured to hold and deposit a cosmetic composition onto a surface, such as a portion of a body of an individual, during use. A position of the first stem limb 4 relative to the second stem limb 6 in the stem configuration 14 defines one or more angles (e.g., angles α, β of FIGS. 3B and 3C) between two or more limbs of the plurality of limbs. Adjustment of the angles corresponds with adjustment of an angle between the at least one applicator limb 5 and the stem configuration 14 and a handle 2 when present. In this manner, with adjustment of the angles, the ergonomic functionality of the cosmetic applicator can be customized for use by one or more individuals.

In embodiments, the at least one applicator limb 5 is flexibly connected to the first stem limb 4 and the second stem limb 6 by a first hinge 7 of the plurality of hinges and a second hinge 8 of the plurality of hinges, respectively. In embodiments, hinges of the plurality of hinges (7, 8) are living hinges. For example, first hinge 7 and second hinge 8 can be living hinges, such that first stem limb 4 and second stem limb 6 are flexibly connected to the at least one cosmetic applicator 5 by living hinges. However, in other embodiments, hinges other than living hinges can be used for flexible connection of first stem limb 4 and second stem limb 6 to the at least one cosmetic applicator 5. In this manner, any suitable hinges can be implemented, as long as they provide flexible connections between limbs.

In embodiments, the at least one applicator limb 5 comprises an elongated groove thereon configured to hold and deposit the cosmetic composition. In embodiments, the elongated groove extends through the at least one applicator limb 5 to form an elongated aperture, as shown by way of example in FIGS. 1A-1B, and 2A-2C. The elongated groove enables easy cleaning and maintenance of the at least one applicator limb 5, for example, to remove grime or buildup of substances within the elongated groove.

In embodiments, the at least one applicator limb 5 can comprise a metal or alloy component that conducts thermal energy, and/or can be rigid in structure. In other embodiments, the at least one applicator limb 5 can include a brush, or other applicator surface, for softly applying a cosmetic composition. In embodiments, the at least one applicator limb 5 can be insert-molded onto a plastic material that can be used for the limbs and/or hinges. In addition, in the shown embodiments, the limbs and hinges are discrete structural features, but in alternate embodiments, the cosmetic applicator can be a unitary structure, such as can be formed by a single mold to form a single continuous structure between the limbs and hinges to form the cosmetic applicator.

Figure 2A:
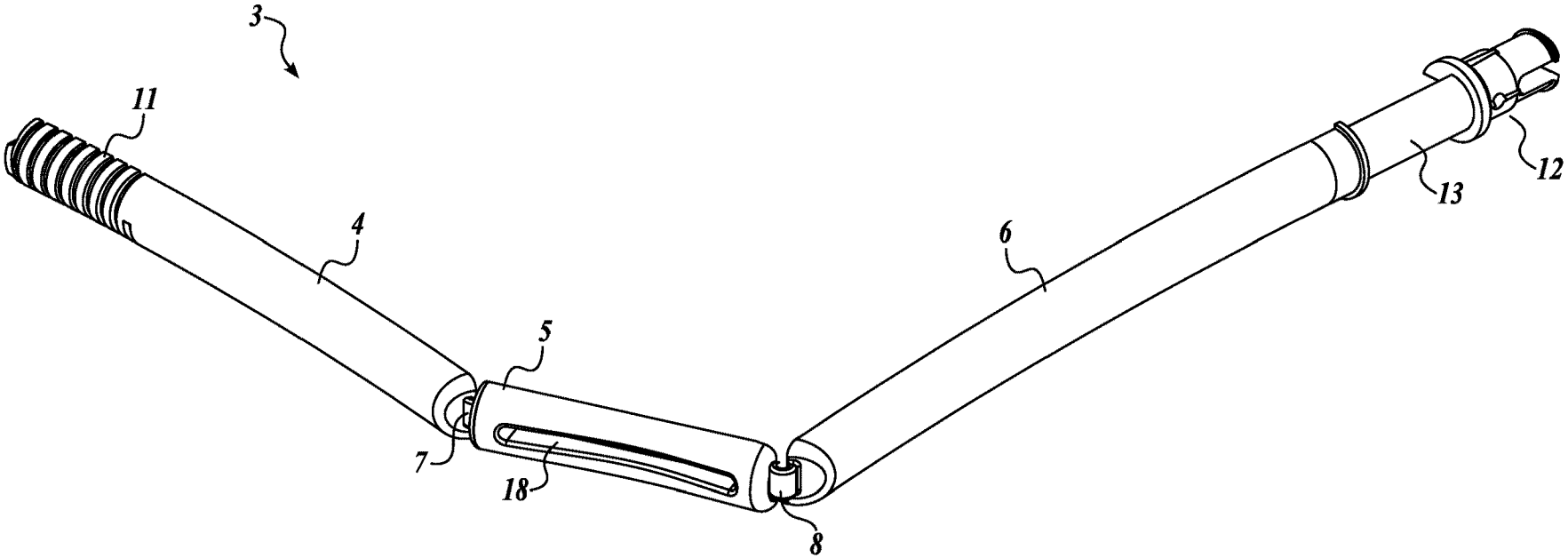
FIG. 2A shows a perspective view of an example cosmetic applicator in an unfolded configuration.
Figure 2B:
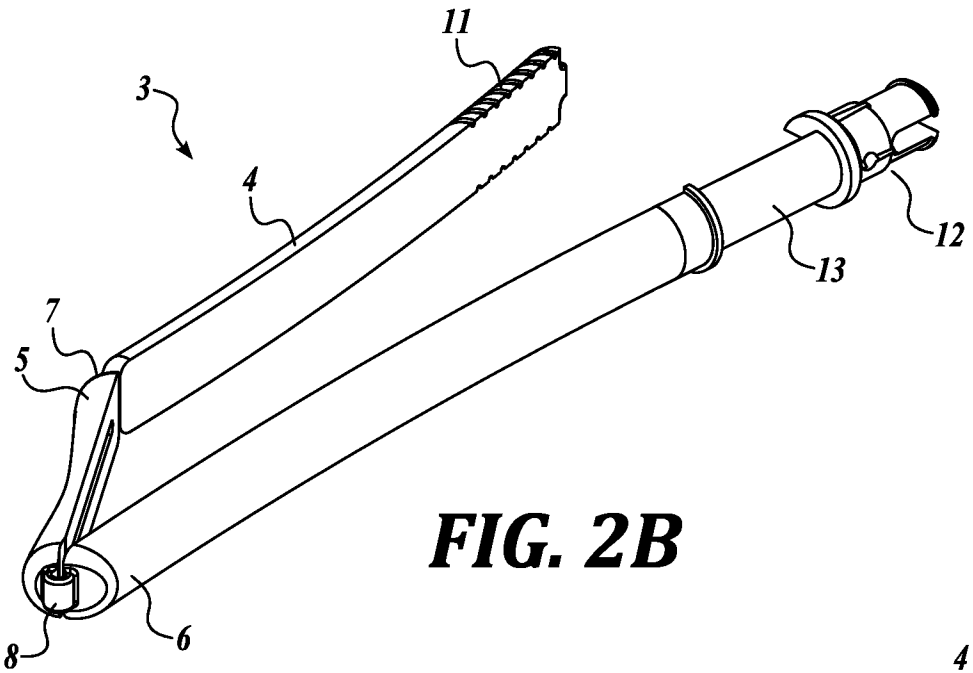
FIG. 2B shows a perspective view of an example cosmetic applicator in a partially folded configuration.
Figure 2C:
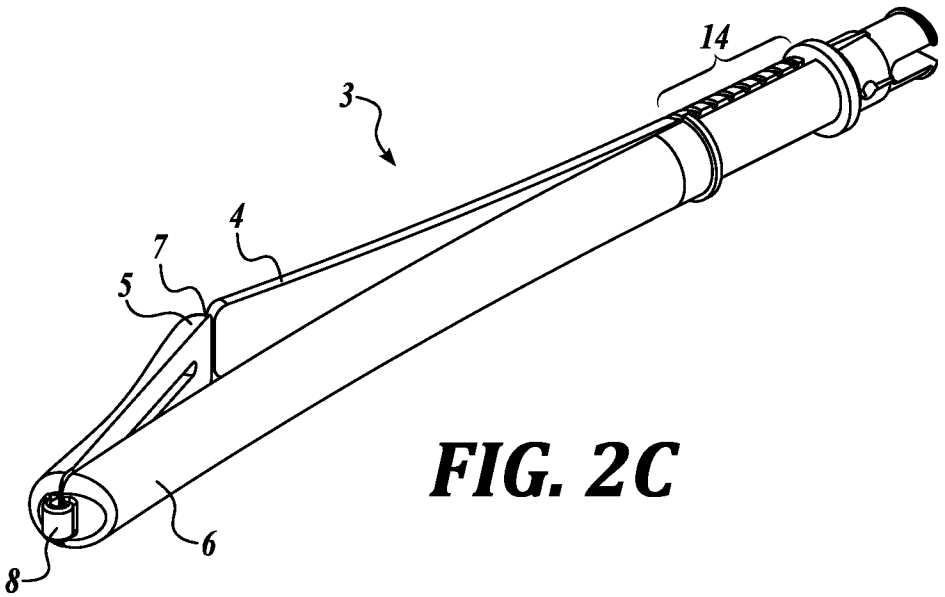
FIG. 2C shows a perspective view of an example cosmetic applicator in a folded configuration.
Figure 2D:
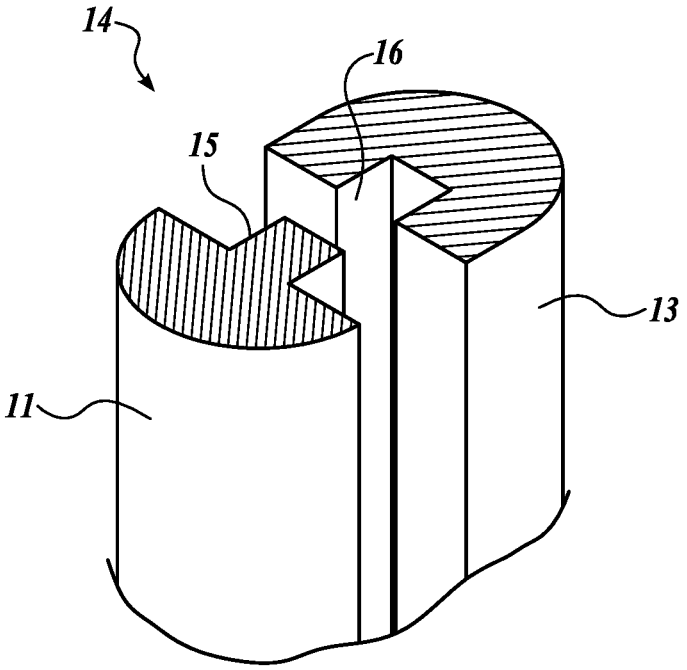
FIG. 2D shows a perspective view of an example interface between limbs of a stem of the folded configuration.

In embodiments, and as shown by way of example at FIG. 2D, the stem configuration 14 comprises a joint formed between a portion 11 of the first stem limb (see, e.g., 4 of FIG. 1A) and a portion 13 of the second stem limb (see, e.g., 6 of FIG. 1A) to secure the stem configuration 14 against horizontal movement of the first stem limb relative to the second stem limb. In embodiments, the joint is configured to allow a vertical movement of the first stem limb relative to the second stem limb for adjustment of angles of the cosmetic applicator, as described herein. In the shown embodiment, the portion 11 of the first stem limb is a male portion 15 and the portion 13 of the second stem limb is a female portion 16. This "tongue and groove" configuration is shown for example only; other joints can be implemented in embodiments without departing from the scope and spirit of the disclosure, including but not limited to a "lock and key" configuration, a "circle and half-circle" configuration, and the like to prevent horizontal movement of the first stem limb relative to the second stem limb.

Figure 3A:
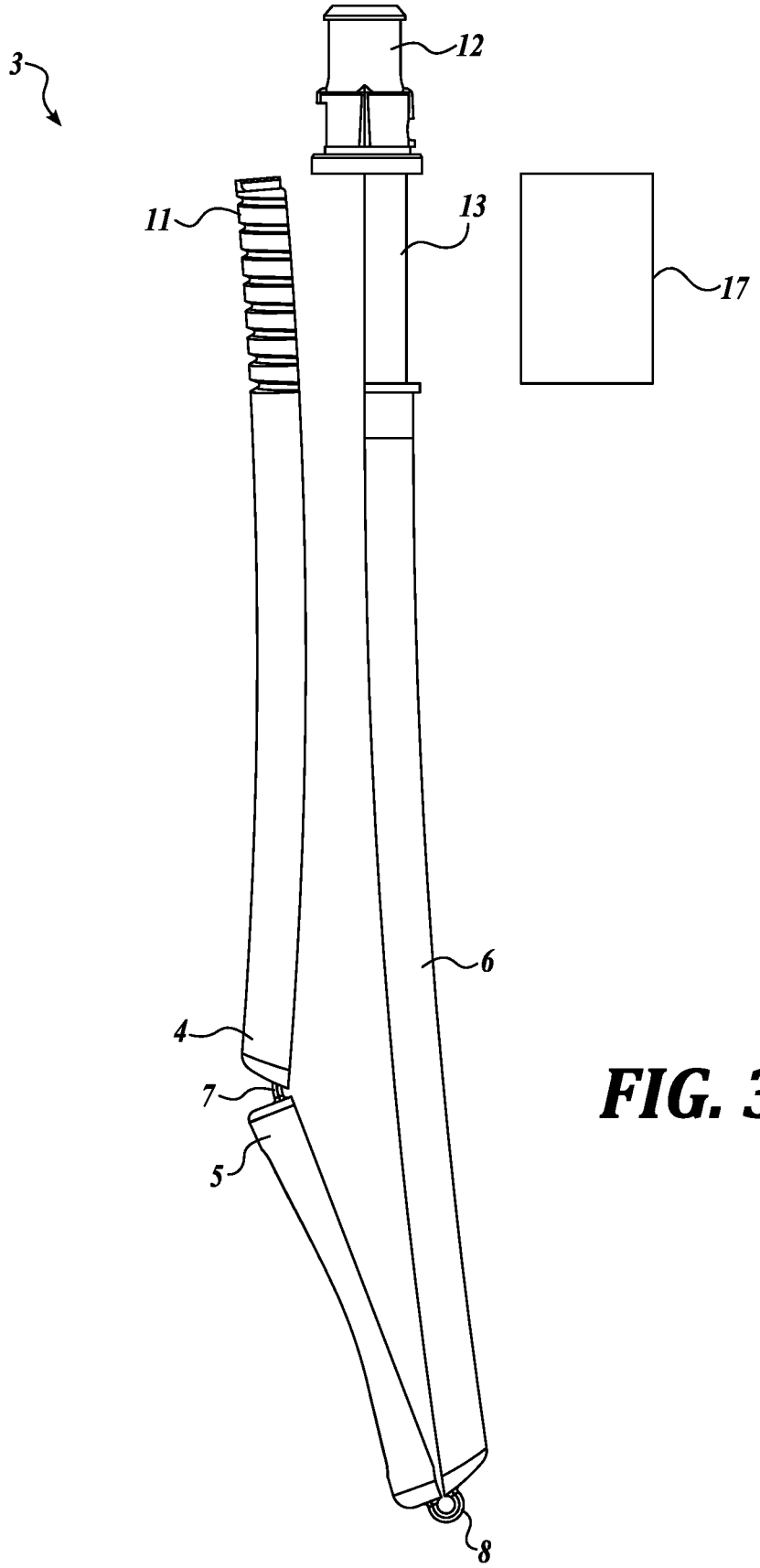
FIG. 3A a perspective view of an example cosmetic applicator configured for dynamic adjustment of angles of limbs of the cosmetic applicator, in an unfolded and disassembled configuration.
Figure 3B:
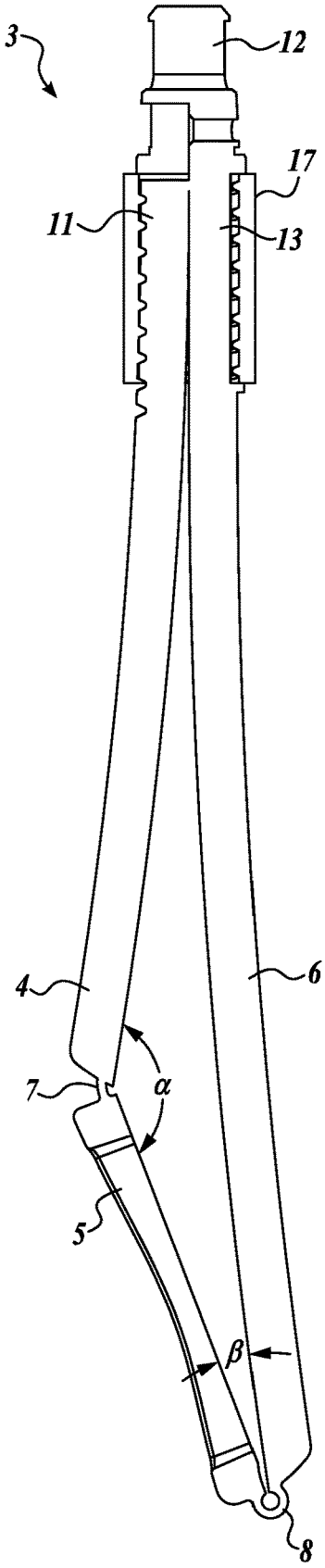
FIG. 3B shows a cutaway side view of an example cosmetic applicator configured for dynamic adjustment of angles of limbs of the cosmetic applicator, in a folded and assembled configuration.
Figure 3C:
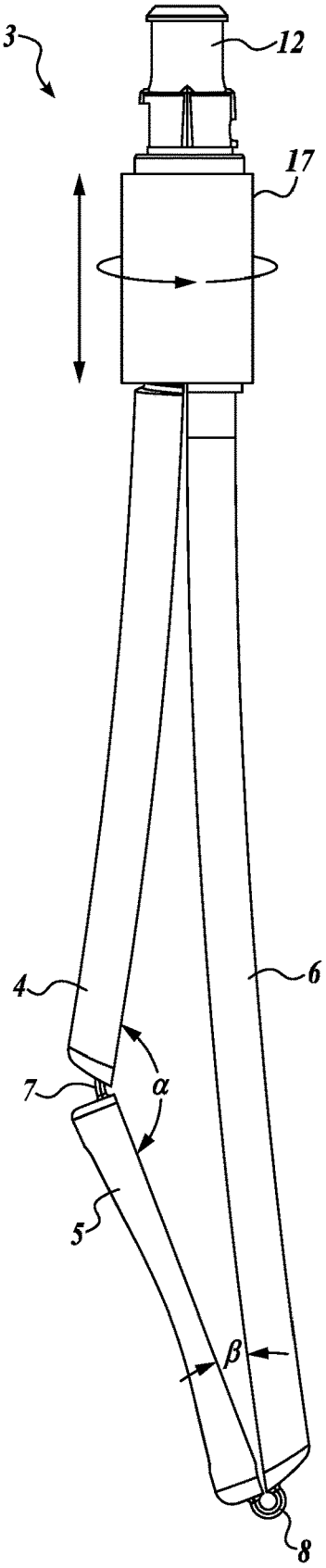
FIG. 3C shows a side view of an example cosmetic applicator configured for dynamic adjustment of angles of limbs of the cosmetic applicator, in a folded and assembled configuration, with arrows indicating rotational movement of a sleeve of the applicator for adjustment of angles $\alpha$ and $\beta$ between the limbs.

As shown by way of example at FIGS. 3A-3C, a vertical movement of the first stem limb 4 relative to the second stem limb 6 at the stem configuration can be implemented, in embodiments, for adjustment of the at least one applicator limb 5 relative to the stem configuration (and any handle attached thereto) for improved ergonomic grasping and use. As shown, a vertical movement of the first stem limb 4 relative to the second stem limb 6 at the stem configuration adjusts the position of the first stem limb 4 relative to the second stem limb 6 and adjusts the one or more angles (e.g., angles α, β) between the two or more limbs of the plurality of limbs. In the shown embodiment, the cosmetic applicator 3 further comprises a threaded sleeve 17 that comprises threading on an inner portion thereof that is engaged with threading on a portion 11 of the first stem limb 4 (e.g., an outer portion thereof), to form a pinion style configuration. In this manner, rotation of the threaded sleeve 17 relative to the stem configuration enables the vertical movement of the first stem limb 4 relative to the second stem limb 6 at the stem configuration, thereby adjusting the one or more angles (e.g., angles α, β) between the two or more limbs of the plurality of limbs. In embodiments, the one or more angles comprises an alpha (α) angle between the first stem limb 4 and the at least one applicator limb 5 and a beta angle (β) between the at least one applicator limb 5 and the second stem limb 6.

As shown at FIG. 1A, a cosmetic applicator 3 can include a handle 2 attached thereto, to form a handled cosmetic applicator 1. The handle 2 can be attached to the cosmetic applicator 3 by way of a handle attachment 12, as shown by way of example at FIGS. 2A-2C and 3A-3C. As shown at FIG. 1A, the handled cosmetic applicator 1 can be implemented with a bottle 10 to form a cosmetic applicator assembly 9, which can be provided with the bottle 10 empty or with a cosmetic composition therein. In embodiments, the cosmetic applicator assembly 9 can further comprise a wiper, connected to the bottle 10 at an aperture of the bottle 10, that is configured to remove excess composition from the cosmetic applicator 3 during removal of the handled cosmetic applicator 1 from the bottle 10. The diameter of the wiper can be configured to snugly and slidingly engage the cosmetic applicator 3, and in embodiments, can be accommodating for greater and lesser angles of the cosmetic applicator which can affect the diameter of the cosmetic applicator 3.

In embodiments, the pinion style configuration can fit inside the handle 2, i.e., inside the space that is within the cosmetic applicator assembly 9 with closure by attachment of the handle 2 to the bottle 10. Since the pinion style configuration fits within the closure and within the wiper orifice/aperture of the packaging, the product can be adjustable, but the adjustability does not affect the sealing or seal of the overall package, which if broken would render the cosmetic composition unusable by drying of the cosmetic composition. In this manner, the cosmetic composition maintains water content and does not dry out, and has a longer shelf life than may be attained with other designs.

In embodiments, one or more components of the cosmetic applicator, such as the plurality of limbs and hinges, and/or the threaded sleeve, can be injection molded for manufacture, however, in embodiments, can be additively manufactured (e.g., 3D printed).

In embodiments, a kit is provided that comprises a cosmetic applicator assembly 9, a cosmetic applicator 3, or another component of the disclosure. The kit can further comprise an instructional material, a product material, or the like. The instructional material can provide instructions as to how to use the handled cosmetic applicator 1 to apply a cosmetic composition and/or how to clean or maintain the cosmetic applicator 3, and the product material can provide information about the cosmetic composition, for example.

NON-LIMITING EMBODIMENTS

While general features of the disclosure are described and shown and particular features of the disclosure are set forth in the claims, the following non-limiting embodiments relate to features, and combinations of features, that are explicitly envisioned as being part of the disclosure. The following non-limiting Embodiments contain elements that are modular and can be combined with each other in any number, order, or combination to form a new non-limiting Embodiment, which can itself be further combined with other non-limiting Embodiments.

Embodiment 1. A cosmetic applicator, comprising: a plurality of limbs attached by a plurality of hinges, wherein the plurality of limbs comprises a first stem limb and a second stem limb configured to securely interact to form a stem configuration and at least one applicator limb configured to hold and deposit a cosmetic composition; wherein a position of the first stem limb relative to the second stem limb in the stem configuration defines one or more angles between two or more limbs of the plurality of limbs.

Embodiment 2. The cosmetic applicator of any other Embodiment, wherein hinges of the plurality of hinges are living hinges.

Embodiment 3. The cosmetic applicator of any other Embodiment, wherein the at least one applicator limb is flexibly connected to the first stem limb and the second stem limb by a first hinge of the plurality of hinges and a second hinge of the plurality of hinges, respectively.

Embodiment 4. The cosmetic applicator of any other Embodiment, wherein the at least one applicator limb comprises an elongated groove thereon configured to hold and deposit the cosmetic composition.

Embodiment 5. The cosmetic applicator of any other Embodiment, wherein the elongated groove extends through the at least one applicator limb to form an elongated aperture.

Embodiment 6. The cosmetic applicator of any other Embodiment, wherein the stem configuration comprises a joint formed between a portion of the first stem limb and a portion of the second stem limb to secure the stem configuration against horizontal movement of the first stem limb relative to the second stem limb.

Embodiment 7. The cosmetic applicator of any other Embodiment, wherein the portion of the first stem limb is a male portion and the portion of the second stem limb is a female portion.

Embodiment 8. The cosmetic applicator of any other Embodiment, wherein a vertical movement of the first stem limb relative to the second stem limb at the stem configuration adjusts the position of the first stem limb relative to the second stem limb and adjusts the one or more angles between the two or more limbs of the plurality of limbs.

Embodiment 9. The cosmetic applicator of any other Embodiment, further comprising a threaded sleeve that comprises threading on an inner portion thereof that is engaged with threading on an outer portion of the first stem limb, wherein rotation of the threaded sleeve relative to the stem configuration enables the vertical movement of the first stem limb relative to the second stem limb at the stem configuration.

Embodiment 10. The cosmetic applicator of any other Embodiment, wherein the one or more angles comprises an alpha angle between the first stem limb and the at least one applicator limb and a beta angle between the at least one applicator limb and the second stem limb.

Embodiment 11. A cosmetic applicator, comprising: a first stem limb, a second stem limb, and at least one applicator limb configured to hold and deposit a cosmetic composition, wherein the at least one applicator limb is flexibly connected to the first stem limb and is flexibly connected to the second stem limb, wherein the first stem limb and the second stem limb are configured to securely interact to form a stem configuration; wherein a position of the first stem limb relative to the second stem limb in the stem configuration is adjustable with a vertical movement of the first stem limb relative to the second stem limb to define an alpha angle between the first stem limb and the at least one applicator limb and a beta angle between the at least one applicator limb and the second stem limb.

Embodiment 12. The cosmetic applicator of any other Embodiment, further comprising a threaded sleeve that comprises threading on an inner portion thereof that is engaged with threading on an outer portion of the first stem limb, wherein rotation of the threaded sleeve relative to the stem configuration enables the vertical movement of the first stem limb relative to the second stem limb at the stem configuration for adjustment of the position of the first stem limb relative to the second stem limb in the stem configuration.

Embodiment 13. The cosmetic applicator of any other Embodiment, wherein the at least one applicator limb is flexibly connected to the first stem limb by a first living hinge and is flexibly connected to the second stem limb by a second living hinge.

Embodiment 14. The cosmetic applicator of any other Embodiment, wherein the at least one applicator limb comprises an elongated groove thereon configured to hold and deposit the cosmetic composition.

Embodiment 15. The cosmetic applicator of any other Embodiment, wherein the elongated groove extends through the at least one applicator limb to form an elongated aperture.

While illustrative embodiments have been illustrated and described, it will be appreciated that various changes can be made therein without departing from the spirit and scope of the invention.

The embodiments of the invention in which an exclusive property or privilege is claimed are defined as follows:

1. A cosmetic applicator, comprising:

a plurality of limbs attached by a plurality of hinges, wherein the plurality of limbs comprises a first stem limb and a second stem limb configured to securely interact to form a stem configuration and at least one applicator limb configured to hold and deposit a cosmetic composition; and a threaded sleeve having threading on an inner portion thereof that is engaged with threading on an outer portion of the first stem limb, wherein a position of the first stem limb relative to the second stem limb in the stem configuration defines one or more angles between two or more limbs of the plurality of limbs, and wherein rotation of the threaded sleeve relative to the stem configuration enables vertical movement of the first stem limb relative to the second stem limb at the stem configuration, which adjusts the position of the first stem limb relative to the second stem limb and adjusts the one or more angles between the two or more limbs of the plurality of limbs.

2. The cosmetic applicator of claim 1, wherein hinges of the plurality of hinges are living hinges.

3. The cosmetic applicator of claim 1, wherein the at least one applicator limb is flexibly connected to the first stem limb and the second stem limb by a first hinge of the plurality of hinges and a second hinge of the plurality of hinges, respectively.

4. The cosmetic applicator of claim 3, wherein the at least one applicator limb comprises an elongated groove thereon configured to hold and deposit the cosmetic composition.

5. The cosmetic applicator of claim 4, wherein the elongated groove extends through the at least one applicator limb to form an elongated aperture.

6. The cosmetic applicator of claim 1, wherein the stem configuration comprises a joint formed between a portion of the first stem limb and a portion of the second stem limb to secure the stem configuration against horizontal movement of the first stem limb relative to the second stem limb.

7. The cosmetic applicator of claim 6, wherein the portion of the first stem limb is a male portion and the portion of the second stem limb is a female portion.

8. The cosmetic applicator of claim 1, wherein the one or more angles comprises an alpha angle between the first stem limb and the at least one applicator limb and a beta angle between the at least one applicator limb and the second stem limb.

9. A cosmetic applicator, comprising:

a first stem limb, a second stem limb, and at least one applicator limb configured to hold and deposit a cosmetic composition, wherein the at least one applicator limb is flexibly connected to the first stem limb and is flexibly connected to the second stem limb, wherein the first stem limb and the second stem limb are configured to securely interact to form a stem configuration; and a threaded sleeve that has threading on an inner portion thereof that is engaged with threading on an outer portion of the first stem limb, wherein a position of the first stem limb relative to the second stem limb in the stem configuration is adjustable by rotation of the threaded sleeve relative to the stem configuration, enabling a vertical movement of the first stem limb relative to the second stem limb for adjustment of the position of the first stem limb relative to the second stem limb in the stem configuration and defining an alpha angle between the first stem limb and the at least one applicator limb and a beta angle between the at least one applicator limb and the second stem limb.

10. The cosmetic applicator of claim 9, wherein the at least one applicator limb is flexibly connected to the first stem limb by a first living hinge and is flexibly connected to the second stem limb by a second living hinge.

11. The cosmetic applicator of claim 9, wherein the at least one applicator limb comprises an elongated groove thereon configured to hold and deposit the cosmetic composition.

12. The cosmetic applicator of claim 11, wherein the elongated groove extends through the at least one applicator limb to form an elongated aperture.

* * * * *